US007146924B1

(12) United States Patent
Vopal

(10) Patent No.: US 7,146,924 B1
(45) Date of Patent: Dec. 12, 2006

(54) KAYAK BALLAST SYSTEM

(76) Inventor: Carl R. Vopal, 3628 Sherbrooke Dr., Mequon, WI (US) 53092

( * ) Notice: Subject to any disclaimer, the term of this patent is extended or adjusted under 35 U.S.C. 154(b) by 0 days.

(21) Appl. No.: 11/171,067

(22) Filed: Jun. 30, 2005

(51) Int. Cl.
*B63B 43/06* (2006.01)
*B63B 35/71* (2006.01)

(52) U.S. Cl. ..... 114/347; 114/125

(58) Field of Classification Search ..... 114/121, 114/122, 124, 125, 347, 123
See application file for complete search history.

(56) References Cited

U.S. PATENT DOCUMENTS

| | | | | |
|---|---|---|---|---|
| 3,385,251 | A * | 5/1968 | Grocott | 114/125 |
| 3,804,050 | A * | 4/1974 | Iarossi | 114/74 A |
| 4,335,987 | A * | 6/1982 | Laxo | 414/27 |
| 5,787,835 | A * | 8/1998 | Remnant | 114/271 |
| 6,343,562 | B1 | 2/2002 | Ingram | |
| 6,435,126 | B1 * | 8/2002 | Burke | 114/363 |
| 6,668,744 | B1 | 12/2003 | Coates et al. | |
| 2002/0069808 | A1 | 6/2002 | Hesse | |

OTHER PUBLICATIONS

"Paddle Wise Discussion on Lead as Ballast", www.paddlewise.net/topics/boatdesign/cockpit-lead.html.

"Sea Kayaks Techniques Bulletin Board", www.kaykakforum.com/cgi-bin/technique/index.cgi/noframes/read/19844.

"Sea Kayaks Techniques Bulletin Board", www.kaykakforum.com/cgi-bin/Technique/index.cgi/noframes/read/19838.

"Boating-Forum.com", www.boating-formum.com/Sea_kayak_ballast_use_of _lead_blanketys_just-an . . . .

"Sea kayak, ballast, use of lead blankets, just an observation", www.talkaboutboats.com/group/rec.boats.paddle.touring/messages/19694.html.

"Canoe Colorado, Performance Canoes And Sea Kayaks", www.canoecolorado.com/kayaking/seda/amigo/.

"Sea Kayaks Techniques Bulletin Board", www.kayakforum.com/cgi.bin/Technique/index.cgi/noframes/read/19836.

* cited by examiner

*Primary Examiner*—Ed Swinehart
(74) *Attorney, Agent, or Firm*—Boyle Fredrickson Newholm Stein & Gratz S.C.

(57) ABSTRACT

A kayak ballast system is comprised of a cradle member configured to be fitted within the interior of the kayak. The cradle member defines a receiving unit for securely receiving weight, thereby providing a ready means for adding weight to a kayak and increasing the center of gravity and overall stability of the vessel. The ballast system is used to increase the boats center of gravity in the inventive method. The ballast system may be positioned throughout the interior of the kayak including the forward end of the cockpit and the cargo holds.

16 Claims, 13 Drawing Sheets

KAYAK BALLAST SYSTEM

FIELD OF THE INVENTION

The present invention relates to kayaks, and more specifically to a kayak ballast system for a kayak cockpit or storage compartment.

BACKGROUND OF THE INVENTION

For decades, kayaking has been recognized as a pleasant way to enjoy the outdoors, and a convenient way to travel to remote regions. The sport of kayaking is reaching an all time high in terms of popularity. Consumer surveys and sales figures have shown the number of individuals participating in the sport is growing at a rate never seen before. Manufacturers, distributors, and guides throughout the country are witnessing this increase in popularity as the demand for their products and services continually increases.

Accompanying the growth of kayaking has been advances in the technology associated with the sport. Annual and bi-annual models are common with a majority of the leading manufacturers. Although minor advances have been made to increase the durability, agility and maneuverability of the modern design, in many ways, the basic design has varied little from the designs first developed by the Inuit of northern Canada.

The kayak currently takes one of two basic forms, either that of the whitewater kayak designed for running rivers, or the sea kayak. The former is generally shorter and of low volume for maneuverability. The latter is longer and of higher volume to provide greater directional stability and allow for the stowage of cargo. In the sea kayak, the paddler is sealed into the boat by a waterproof "skirt" worn around the waist and sealed around the lip of the cockpit in which the paddler sits. The skirt prevents water from entering the kayak even when the kayak is overturned. The sport of sea kayaking recognizes no geographic limit. The sport has been enjoyed in peaceful inland lakes and rivers, the violent and rough seas of the North Atlantic and virtually every waterway in between. In many ways, the geographic limits of the expedition are only set by the spirit and courage of the kayaker.

Hull designs are not created equal. Two 18 foot boats from competing manufacturers will leave different footprints on the water. What a kayak will do and how well it will perform in the water is determined by the compromise of beam (width), displacement (hull design) length and the kayaker. As this magic blend is reached, the center of gravity lowers, thus increasing the stability.

Increasing the overall stability, by lowering the center of gravity, may assist the kayaker in performing the Eskimo roll (or simply "roll"), one of the most critical safety maneuvers in kayaking. As noted above, in the sea kayak, the paddler is sealed into the boat by a waterproof skirt worn around the waist and sealed around the lip of the cockpit in which the paddler sits. Despite the overall stability of the basic kayak design, in rough waters or simply due to a loss of balance, a kayaker may overturn his or her kayak resulting in a critical and somewhat dangerous situation.

An overturned kayak places the kayaker in a difficult position in which he or she must make several critical decisions within a few seconds. In the best case scenario, an overturned kayak may be righted by the paddler without removing the skirt by performing an Eskimo roll. To do a roll, the paddler applies sufficient torque using correct orientation and movement of the paddle to rotate the boat and his or her body to an upright position. Alternatively, if the paddler is unable to right the boat using the Eskimo roll, but a second boat is near, a rescue can be performed in which the second boat is brought close enough to the capsized boat so that the capsized paddler's waving hand can grasp its bow. The capsized paddler can use the support of the second boat's bow to rotate him- or herself to an upright position without exiting his/her boat.

As a final alternative, a paddler unable to right the kayak can free him or herself from the boat by releasing the skirt from the cockpit rim and slipping out of the cockpit while underwater. This is the least desirable option because it exposes the kayaker and the kayak to the elements. If a sea kayaker fails to right the boat and it becomes necessary to release the skirt and exit the boat, he/she is confronted by a number of life-threatening dangers. The kayaker may become separated from the boat and/or paddle, possibly far from shore and possibly in rough seas. The temperature of the water will often be low enough to reduce the paddler's strength over a fairly short time, and make re-entry to the boat more difficult. This serious situation can lead to hypothermia and/or drowning, and fear or panic can further complicate the situation. Even if the paddler succeeds in re-entering the boat it will be filled with water, unstable, and liable to re-capsize before it can be emptied. Consequently the preferred response to a capsize is righting the boat without the paddler exiting the boat. Thus, any device that may increase the ability of the kayaker to right themselves following a capsize is desirable.

The paddler's body and shape and size will affect the paddler's feel of the kayak. A short round body will have a lower center of gravity verses a long slender, broad shouldered paddler. The center of gravity is centered in the paddler at about the belt line. It is the center of the combined weight of the paddler and boat. The boat's performance may be enhanced or lessened by the paddler's height and weight.

A lighter paddler may feel the boat uncomfortable or tippy when the boat is at rest. With a lighter paddler, the boat will have a shallow footprint. The boat's working water-line will be shorter causing the boat to feel tippy. This tippyness feeling poses a significant problem to newer or less experienced paddlers who desire a high degree of stability. Not only does the lack of stability lessen the overall safety of an expedition, but it can also lessen ones enjoyment in the experience.

Finding the right fitting boat may not be an option for individuals below the "average" weight, which most kayaks consider in their design. This poses a significant problem for expedition's guides who have a limited number of kayaks to accommodate the full spectrum of paddlers. There is a strong need in the industry to accommodate beginner paddlers, and give them the security and comfort in the water to allow them to fully enjoy their experience. This added comfort may be obtained by adding weight close to the center along the boat's keel line.

Additionally, it is recognized that even experienced paddlers may desire to lower the center of gravity of the kayak depending on the sea or river conditions. In rougher conditions, a lower center of gravity may be desirable. Likewise, many touring kayaks are designed with large storage compartments capable for carrying large amounts of cargo. Owners of these larger boats have found them to be cumbersome and less maneuverable on day trips due to the lack of overall cargo. The lack of weight results in a significant decrease in the stability and maneuverability of the large touring kayak.

To date, there has been no easy, way to add and remove weight to the kayak in a manner that optimizes the kayaks center of gravity and thus its overall stability. As it can be appreciated from the discussion above, there is an obvious need to improve the stability and maneuverability of kayaks for individuals of all skill levels. There is a further need for a system that optimizes the positioning of any added weights and keeps the weights stable within the kayak. There is an additional need for a device which may increase a paddler's ability to right an overturned kayak without exiting the kayak.

SUMMARY AND OBJECTS OF THE INVENTION

In light if the foregoing, it is an object of the invention to provide a ballast system that increases the center of gravity of a kayak and thus increases the overall stability of the boat. It is another object of the invention to provide an apparatus which is quickly and easily installed into any kayak. It is a further object of the present invention to provide a kayak ballast system that is easy to install using existing parts and maintains weight in the center of the boat thereby increasing the degree of lean in a boat and assisting a kayaker in performing a roll. Still another object of the invention is to provide a system that has one or more of the characteristics discussed above but which is relatively easy to setup. Yet another object of the invention is to provide a system that can be used to relatively inexpensively adjust the center of gravity of a kayak.

Consistent with the foregoing objects, and in accordance with the invention as embodied and broadly described herein, a ballast system, a kayak ballast device, and method of increasing the center of gravity in a kayak are disclosed in suitable detail to enable one of ordinary skill in the art to make and use the invention.

By way of summary, the present invention is generally directed to a ballast system to be used in a wide variety of kayaks, canoes and watercraft, and also to a method for using such a ballast system.

In one embodiment, a ballast system for a watercraft includes a cradle member for receiving weight configured to be positioned within the interior of the watercraft. The cradle member may be an elongate member defining a first end and a second end and configured to be secured against the interior of the watercraft. The cradle member may define a receiving unit for attaching weight.

In another embodiment, the cradle member includes a receiver, and the weight defines a recess configured to receive the receiver. The weight may define at least one through bore configured to align with a passage on the receiver, and the through bore and passage may be configured to receive a pin therethrough.

In still another embodiment, the weight may be comprised of a container that includes at least one opening allowing access to the interior of the container. In yet another embodiment, a mounting plate may be attached to the bottom of the watercraft and configured to engage to the underside of the cradle member and limit movement of the cradle member. The mounting plate may include at least one projection configured to engage a recess on the weight receiving unit. The system may also be secured to the interior of the kayak by straps secured to the bulkhead of a kayak. The system may include an end cap attached to an end of the cradle to engage the interior wall of the watercraft.

In another preferred embodiment, a kayak ballast device includes a weight receiving unit configured to be attached to the interior of a kayak and attach to a weight. The weight may be a container configured to be received by the weight receiving unit and the container may define an opening for the placement and removal of weight. In one embodiment, the container defines at least one through bore configured to align with a passage on the weight receiving unit, and the through bore and the passage are configured to receive a pin therethrough.

In another embodiment the ballast device includes a cradle member supporting the weight receiving unit and the cradle member is configured to be press-fitted within the interior of the kayak. The cradle member includes an end cap that includes an angled face.

In a final embodiment, a method of increasing the center of gravity in a kayak includes the steps of providing a support that includes a weight receiving unit configured to be positioned within the interior of a kayak, positioning the support within the interior of the kayak and securing a weight to the weight receiving unit. The weight may be a container defining at least one opening and the method may further include filling the container with a material. The weight may further define at least one through bore configured to align with a passage on the weight receiving unit and receive a pin therethrough.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which:

FIG. 17*a* top plan view of the pin utilized with the ballast system illustrated in FIG. 8;

Figure 1:
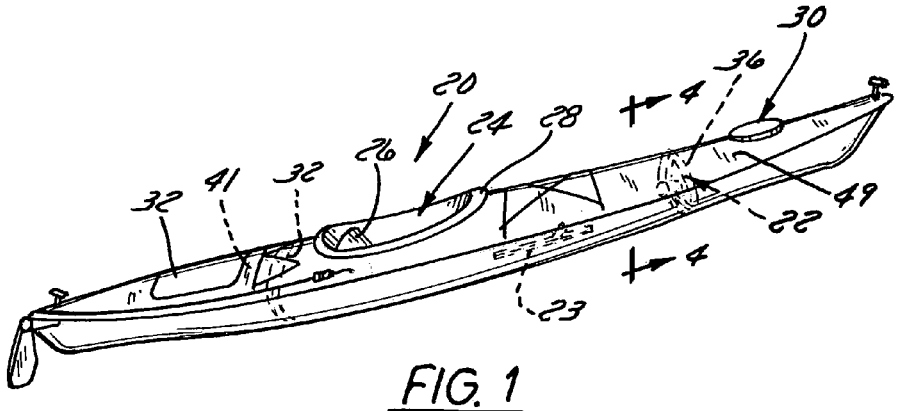
FIG. 1 is a perspective view of a sea kayak incorporating a ballast system in accordance with the present invention.

Before explaining one or more embodiments invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE INVENTION

Turning now to the drawings, and more particularly to FIG. 1 thereof, a kayak 20 is shown incorporating the inventive ballast system 22. It should be understood that kayaks are well known in the art, and the inventive ballast system 22 is configured to be readily adapted for use with any of a number of known designs. Although the preferred embodiment of the present invention is described in reference to a sea kayak 20, the design of the particular kayak is in no way limiting on the inventive ballast system 22. The basic design of the ballast system 22 may be utilized by a wide variety of vessels including whitewater kayaks, sea kayaks, and canoes.

In the illustrated embodiment, kayak 20 is a conventional sea kayak known in the art. Kayak 20 includes a centrally located cockpit 24 with a seat 26 in which a kayaker sits with his legs extending forward. The cockpit has a raised combing 28 to allow an elasticized edge of a spray skirt (not shown) which the kayaker wears around his waist to overlap the lip of the combing 28 and prevent water from entering the cockpit.

As shown in FIG. 1, a forward cargo hold 30 and a stern cargo hold 32 are accessible for stowing and retrieving cargo through openings defined therein. Additionally, as will be described in greater detail below, cargo holds 30, 32 can also be used as an alternate location for placement of the inventive ballast system 22. The forward cargo hold 30 is separated from the cockpit 24 by a water tight forward bulkhead 36, shown in phantom, in FIG. 1 and the stern cargo hold 42 is separated from the cockpit 32 by a water tight stern bulkhead 38.

Figure 2:
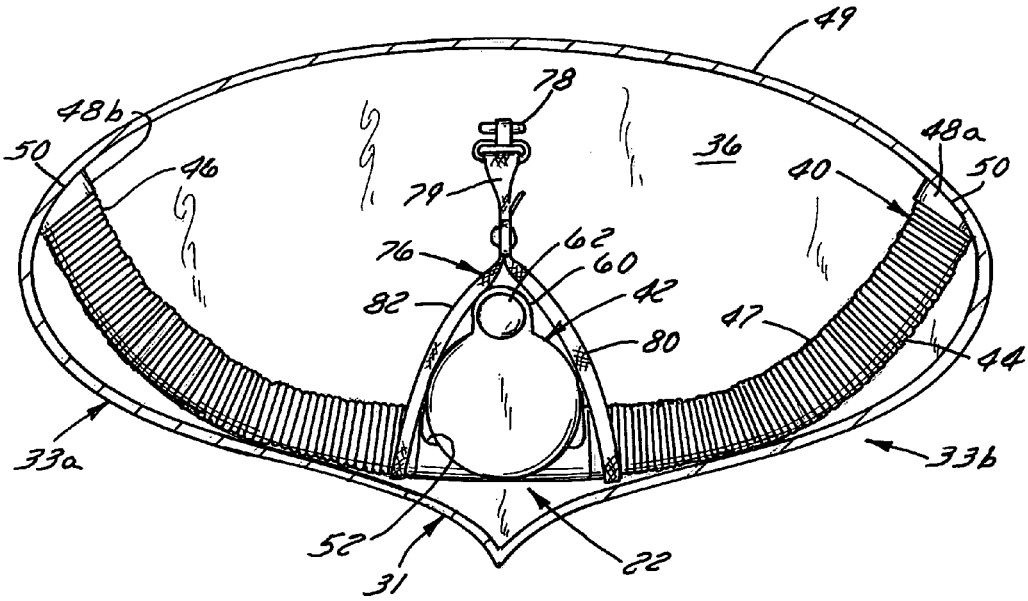
FIG. 2 is a sectional perspective view of the kayak along lines 4—4 in FIG. 1 illustrating the ballast system attached to the front bulkhead of the kayak.

Turning now to FIG. 2, the inventive ballast system 22 is illustrated positioned in the forward end of the cockpit 24 against the inner surface of the forward bulkhead 36. It should be understood, however, that ballast system may be alternatively placed within the forward 30 or stern 32 cargo holds against the opposite sides of the bulkheads, in a manner similar to that illustrated. Furthermore, the ballast system may be placed directly in front of the seat of a kayak such that it is positioned under the knees of the kayaker when positioned in the kayak. In the illustrated embodiment, ballast system 22 is positioned in front of footholds or pedals 23 shown in phantom against the forward bulkhead 36. The ballast system 22 is generally comprised of a cradle member or support 40 configured to be fitted within a kayak cockpit or within one of the cargo holds 30, 32 and retain a weight 42.

In the illustrated preferred embodiment, cradle member 40 is an elongate flexible tubular member having a first 44 and second 46 end. Cradle member 40 may be comprised of a variety of known materials. Preferably, cradle member 40 is constructed from PVC or other plastic. By way of example, cradle member 40 may be constructed from 2.25, 3.0 or 3.5 inch corrugated flexible plastic hose. In the illustrated embodiment, cradle member 40, is constructed from corrugated plastic and includes plurality ridges 47. Preferably, cradle member 40 is constructed from a soft or flexible plastic, such that cradle member 40 can be bent into a general U-shape to be press-fitted within the cockpit 24 or storage compartments 30, 32 of a kayak. As shown in FIG. 2, cradle member 40 is bent to be press fitted into the kayak against the bottom 31 and sidewalls 33*a*, 33*b* of the interior of the kayak. Alternatively, cradle member 40, could be preformed into a U-shape from a more rigid plastic or other material to similarly fit within the cockpit or storage compartment of a kayak.

In the preferred embodiment, cradle member 40 is cut from corrugated plastic to a length of about 26 inches in order to allow it to be wedged within the hull of the kayak 20. It is understood that a wide variety of lengths could be used to accommodate differing hull sizes. In a commercial setting, it is understood that additional length may be preferably provided to allow a consumer to cut cradle member 40 in order to custom fit the ballast system 22 to his or her kayak. Preferably, some indicia or other form of marking may be included on the cradle member to assist a user in custom fitting the ballast system 22 to his or her boat. For example, cradle member may include markings on its opposed ends corresponding to centimeters or inches of tube length.

As illustrated in FIG. 2, cradle member 40 may additionally include a pair of rubber or plastic end caps 48*a*, 48*b* configured to inserted into the first 44 and second 46 ends of the cradle member 40. Preferably, end caps 48*a*, 48*b* are removably press-fitted within the ends 44, 46 of the cradle member 40 to accommodate adjustment of the length of the cradle member. End caps 48*a*, 48*b* are configured to assist in press fitting cradle member 40 against the inner surface of the upper wall 49 of the kayak and hold the ballast system 22 in place. In the illustrated embodiment, end caps 48*a*, 48*b* include an angled face 50 to better fit against the arcuate contour of upper wall 49 of the kayak. End caps 48*a*, 48*b* may additionally include a wide variety of friction enhancing mechanisms on the angled face 50 to maintain the ballast system in a desired location within the kayak. For example, the angled contact surface of the end caps 48*a*, 48*b* could include ridges, bumps or any other friction-engaging surface to increase the frictional engagement of the cradle member against the upper wall of the kayak. Alternatively, end caps 48*a*, 48*b* could be constructed from a rubber or other material with a generally high frictional coefficient.

Figure 3:
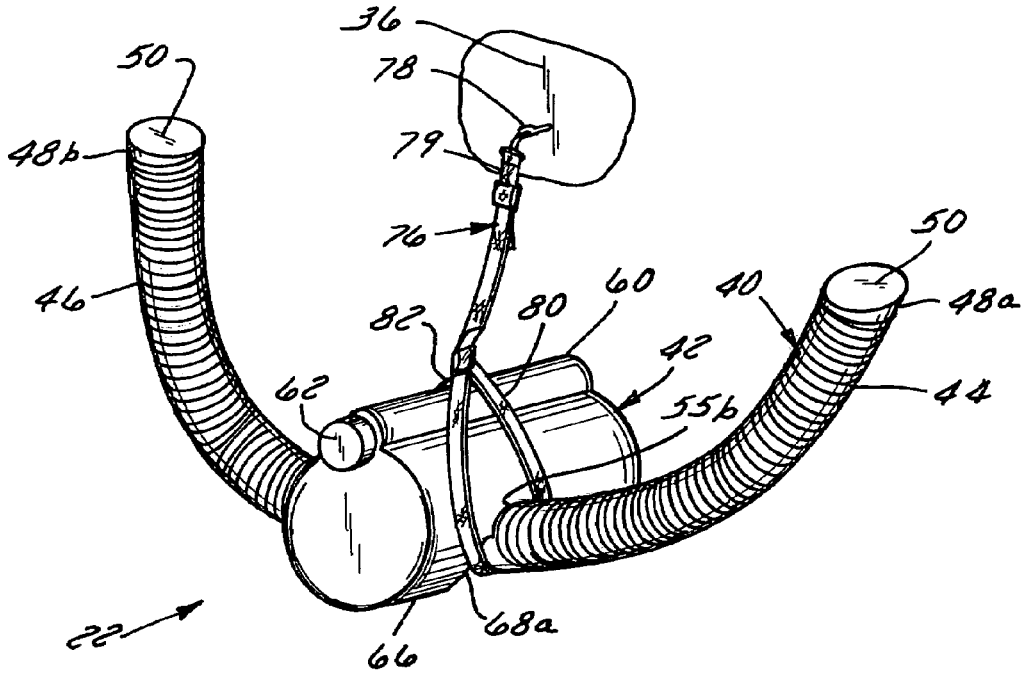
FIG. 3 is a partially cut away perspective view of a kayak ballast system of FIG. 2.
Figure 4:
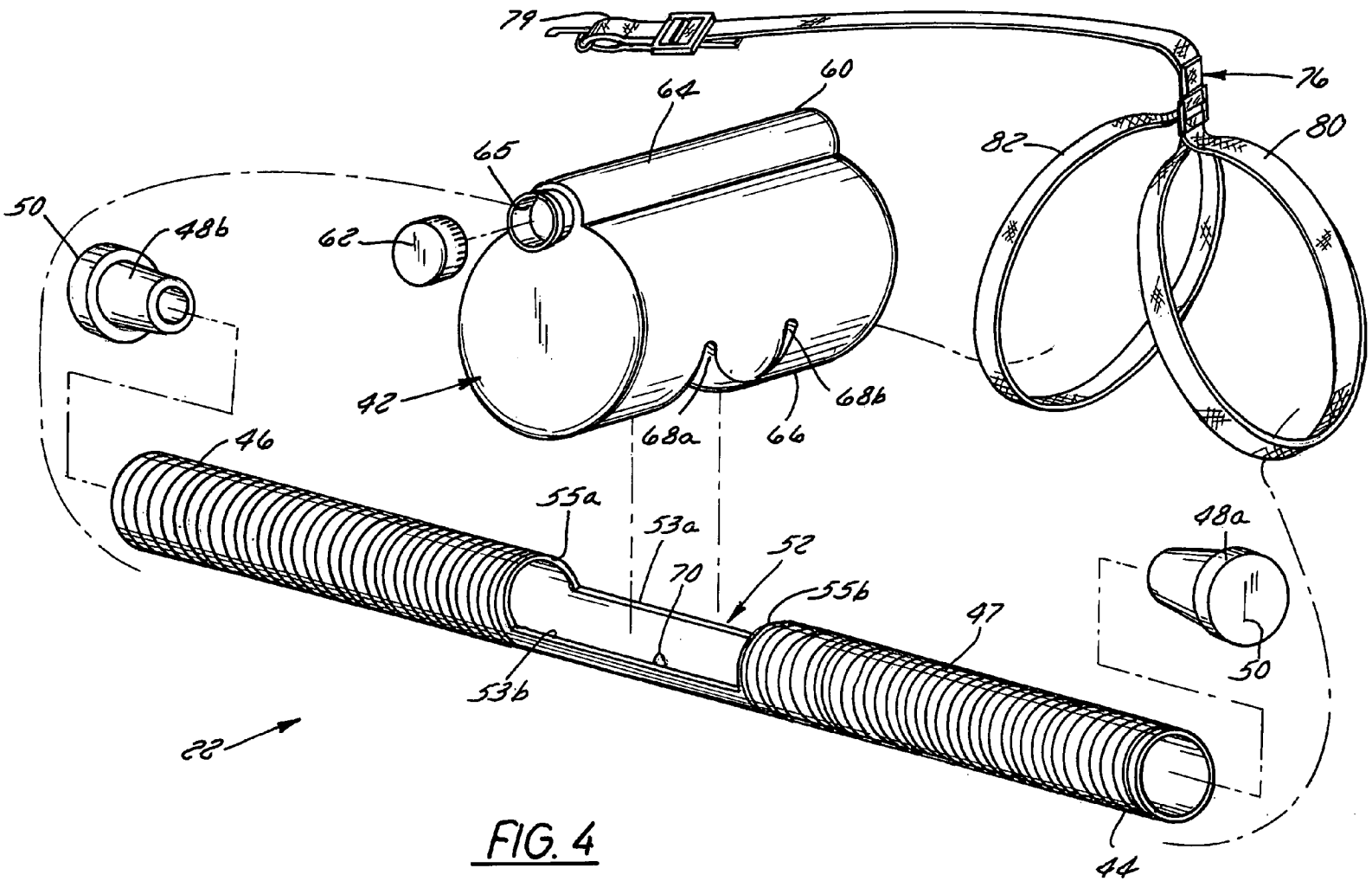
FIG. 4 is a fragmentary perspective view of the kayak ballast system.

Turning now to FIGS. 2–4 the cradle member 40 includes a centrally located weight-receiving unit 52. Weight receiving unit 52 is preferably cut out from the tubular cradle member 40 at a central location and is generally configured to receive some form of weight 42. Preferably, unit 52 is cut out of the cradle member 40 in a manner such that it will substantially align with the center of the kayak when the ballast system 22 is installed. While it is recognized that any increase in weight will increase a kayak's center of gravity, it is preferred that the weight be placed in a generally centralized region of the boat near the paddler in order to maximize the center of gravity and stability of the kayak. Weight receiving unit 52 defines first 53*a* and second 53*b* lateral edges, and first 55*a*, and second 55*b* curved side edges. The dimensions of unit 52 may be altered to accommodate the specific dimensions of the cradle member 40. In the described preferred embodiment, unit 52 provides sufficient space to support a wide variety of weights. For example, five or ten pound lead dive weights could be placed within the unit 52 and secured with a bungee chord, plastic cord, buckle, strap or other known retaining means. Alternatively, it is recognized that weight may be formed integrally within a central region of the cradle member 40.

Figure 7:
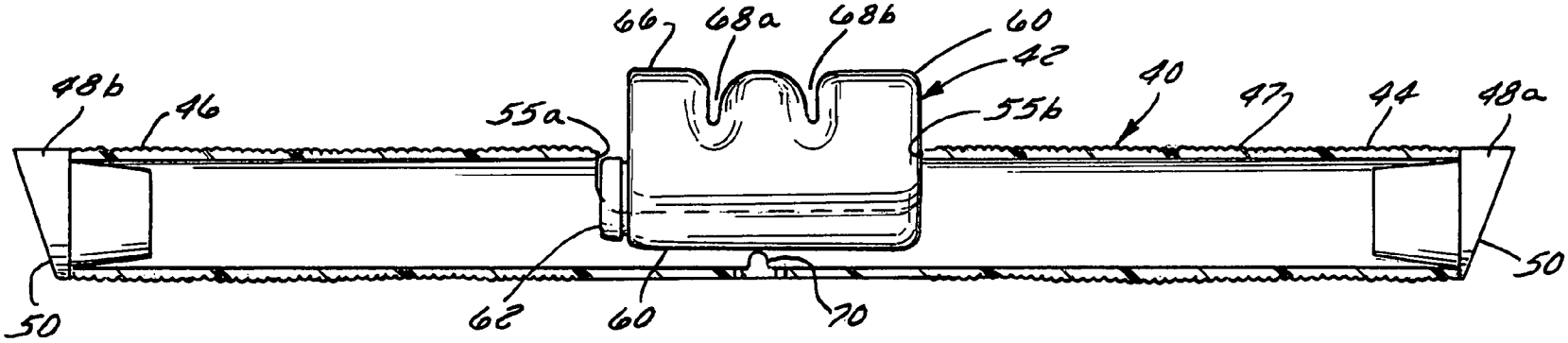
FIG. 7 is a side sectional view of the ballast system in the second operating position.

In the illustrated embodiment, weight 42 is comprised of a plastic container 60 with a removable end cap 62. Container 60 is configured to fit within the unit 52 of cradle member 40 in either a generally perpendicular arrangement (FIG. 3) or a generally parallel arrangement (FIG. 7). It is understood that container 60 can take a wide variety of configurations. It is preferred that container 60 be configured to fit tightly within cradle member 40. In the illustrated embodiment, container 60 is comprised is a generally circular body comprised of an upper surface 64 and a lower surface 66. As illustrated in FIG. 4, upper surface 64 includes a threaded opening 65 configured to receive end cap 62. Lower surface 66, includes a pair of gaps 68*a*, 68*b*. Gaps 68*a*, 68*b* are configured to receive and engage first 53*a* and second 53*b* lateral edges of unit 52 when the container is placed within the unit 52 of the cradle member 40 in a perpendicular arrangement (FIG. 3). The interaction of the gaps 68*a*, 68*b* and the lateral edges 53*a*, 53*b* increases the retention forces acting on the container 60 within the unit 52.

Figure 5:
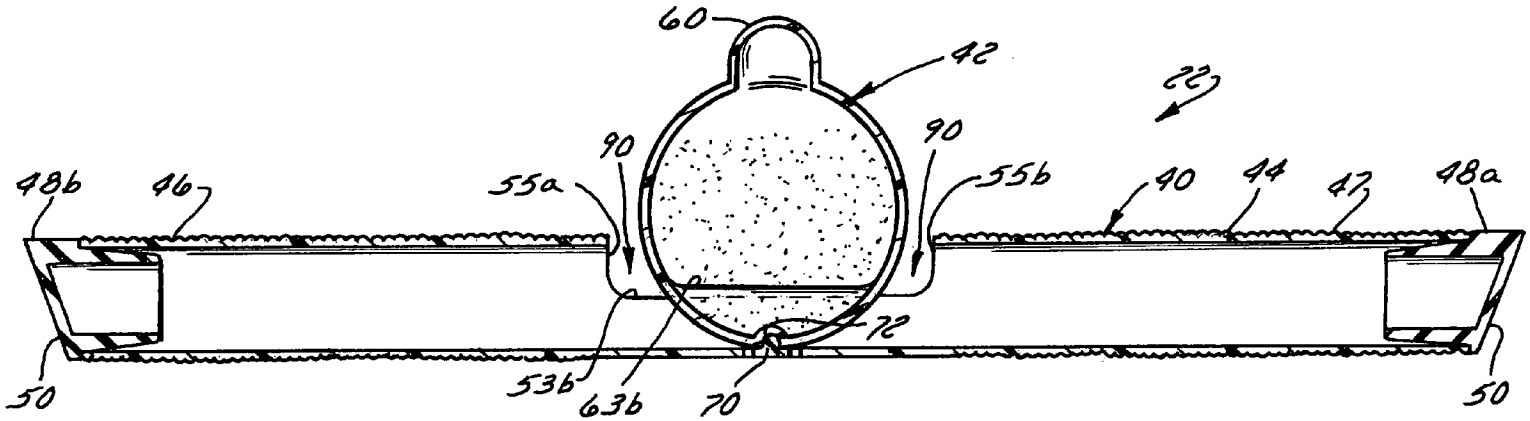
FIG. 5 is a side sectional view of the ballast system in the first operating position.
Figure 6:
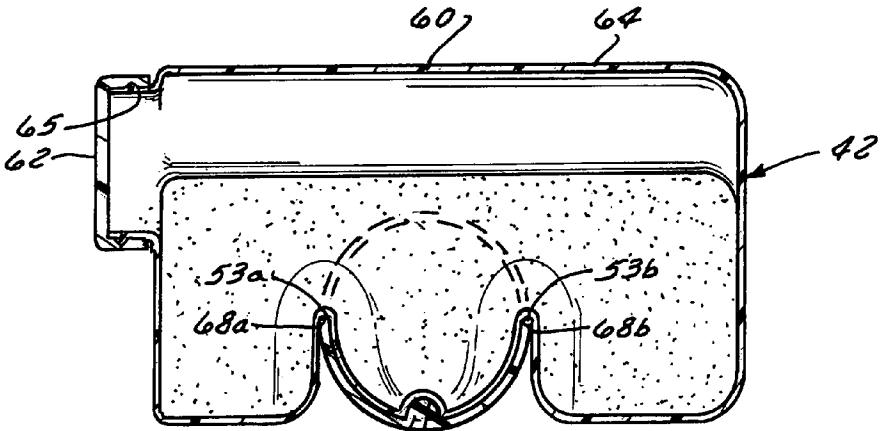
FIG. 6 is a side sectional view of the weight container of the inventive ballast system.

In the illustrated embodiment, the lower surface of unit 52 comprises a nipple 70 projecting upwardly therefrom. As best illustrated in FIG. 5, nipple 70 is configured to be received by a cavity 72 located on the lower surface 66 of the container 60. The interaction of the nipple 70 and cavity 72 assists in holding the container 60 in place within the cradle member 40.

Container 60 is preferably constructed from plastic or another known suitable material. Container 60 provides a useful alternative to dive weights or other known weights which may be used with the present systems. The problem with such permanent weights is that once they are brought on an expedition they are not readily disposed of. Alternatively, container 60 allows a user to use a wide variety of naturally occurring materials to add weight to the kayak. For example, sand, rock, or water may be added and removed through the threaded opening 65 of container 60 to add weight to the kayak by use of the ballast system 22. A user simply removes the end cap 62 from the container 60 and fills the container with any suitable material. The user can than secure the end cap 62 and position the container 60 within the cradle 40. If the weight is no longer desirable due to more stable conditions or the necessity to portage, the weight may be easily removed by emptying the material through the threaded opening 65.

In the illustrated embodiment, in addition to the tight fit of the cradle member 40 and end caps 48*a*, 48*b* against the interior walls of the kayak, cradle member 40 is further secured in place by a harness or strap 76 secured to the bulkhead of the kayak. Strap 76 may take a variety of configurations and serves a dual function of maintaining the weight 42 within the cradle member 40 and securing the cradle member in a desired position within the kayak. In the illustrated embodiment, strap 76 includes a first end 79 secured to a screw, bolt or other fastener 78 inserted through the bulkhead 36 of the kayak. Strap 78 includes first 80 and second 82 adjustable loops configured to placed around the cradle member of the ballast system 22. Both the length of the first end 79 and the loops 82, 80 may be tightened around the ballast system 22 to secure the weight 42 within the cradle member 40 and secure the ballast system 22 against the bulkhead 36, thereby preventing swaying and backward movement of the ballast system 22. Strap 78 also secures the kayak ballast system 22 in position during a capsize and subsequent Eskimo roll.

It should be recognized, however, that strap 76 is not necessary for the kayak ballast system 22. Due to its tight fit within the hull of the kayak, ballast system 22 and its component parts are configured to stay in place without the use of any straps or other securing devices. As illustrated in FIGS. 2 and 3, as cradle 40 is bent into its U-shaped configuration within the hull, it presses against container and secures the container in place within the cradle. As best illustrated in FIG. 5, when the container 60 is initially positioned within the cradle member 40, gaps 90 exist between the container 60 and the first 55*a*, and second 55*b* curved side edges of the unit 52. As illustrated in FIGS. 2 and 3, as the cradle member is moved into its curved position within the kayak, the first 55*a* and second 55*b* edges of the unit squeeze against the container 60 thereby maintaining it in place and preventing the container from being jolted or otherwise removed from the cradle member 40 while in use. The tight fit of the cradle member 40 against the container 60 maintains the container within the cradle 40 member during a capsize and subsequent Eskimo roll.

FIG. 7 illustrates and alternative arrangement of the container 60 within the cradle member 40. Container 60 is positioned in a parallel relationship to the cradle member 40. This alternative configuration allows the ballast system 22 to be placed tightly against the bulkhead 36 or directly under the legs of a kayaker.

In use of the inventive ballast system 22, a user first obtains the cradle member 40. The cradle member 40 is then temporarily positioned within the forward end of the cockpit 24 or within the storage compartments 30, 32 of the kayak 20 to check its length. If the cradle member 40 needs adjusting, the cradle member 40 may be cut down on its outer ends 44, 46, or alternatively, plastic O-rings may be added to the ends of the cradle member 40 between the end caps 48*a*, 48*b* to increase the overall length of the cradle member 40. Once a sufficient cradle member length is established, end caps 48*a*, 48*b* are positioned in the ends 44, 46 of the cradle member 40. Weight 42 is then positioned within the unit 52. If straps or other fasteners are being used, the straps may be secured around the cradle member 40 and weight 42 and tightened. The cradle member 40 is then bent into a general U-shape to conform to the interior of the kayak 20 and placed against the forward bulkhead 36 or other desired location. As the cradle member 40 is bent the first 55*a*, and second 55*b* curved side edges of the unit 52, press tightly against the weight 42, thereby securing it in place. End caps 48*a*, 48*b* of cradle member 40 press tightly against the inner surface of the kayak, thereby securing the ballast system 22 in place. If straps or other securing devices are being used, straps 78 may be tightened around the ballast system 22 and secured to the bulkhead 36 or other portion of the kayak.

FIGS. 8–24 illustrate a second preferred embodiment of the inventive kayak ballast system 122. The ballast system 122 is generally comprised of a cradle member or support 140 configured to be fitted within a kayak cockpit or within one of the cargo holds 30, 32 and retain a weight 142 configured to be attached to a weight receiving unit 152 via a pin 147.

Figure 8:
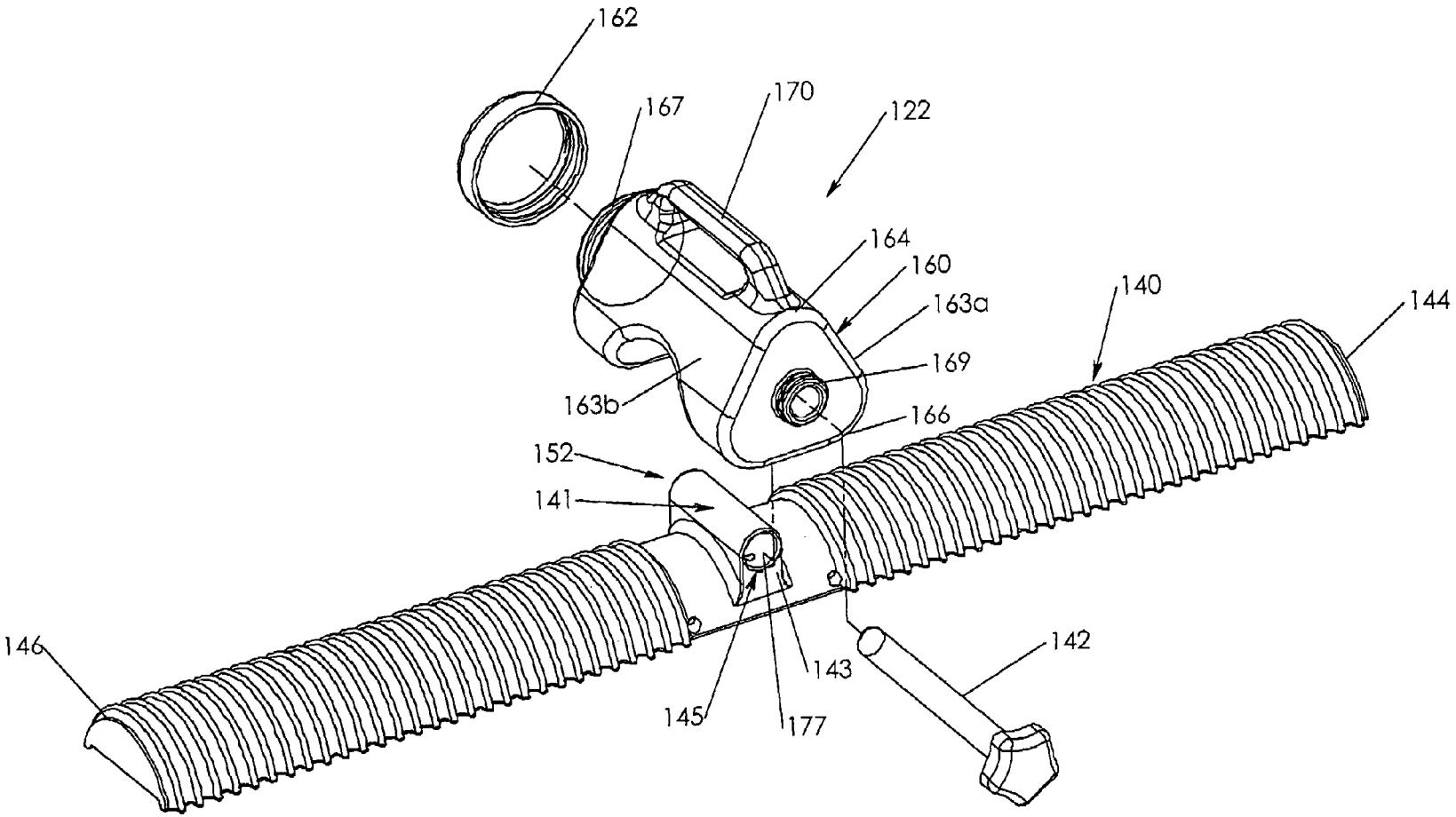
FIG. 8 is a fragmentary perspective view of an alternative preferred embodiment of the kayak ballast system.
Figure 9:
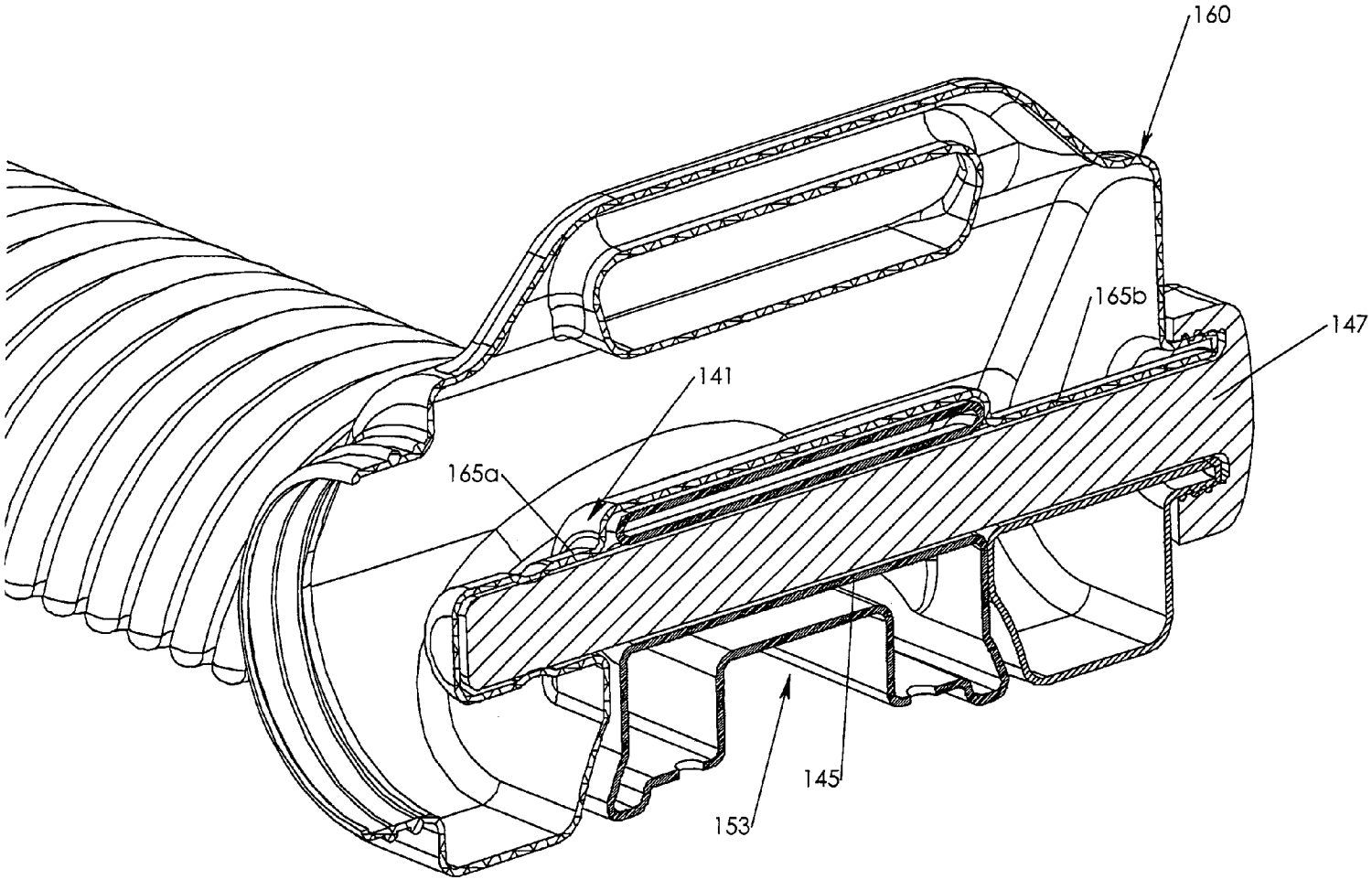
FIG. 9 is a side cross sectional view of the ballast system illustrated in FIG. 8.

FIGS. 8 and 9 illustrate an alternative preferred cradle member 140. Cradle member 140 is likewise an elongate flexible tubular member having a first 144 and second 146 end. A weight receiving unit 152 is orientated in a central region of the cradle member 140. In the embodiment shown in FIGS. 8 and 9, cradle member 140 is semi-circular and the underside of the cradle member is substantially hollowed out. The weight-receiving unit 152 includes an outwardly projecting connector 141. Connector 141 includes a base 143 and tubular receiver, through bore or orifice 145 defining a passage 177 configured to receive a pin 147 therethrough and secure weight 142 to cradle member 140. It should be understood that receiver 145 need not be circular or hollow throughout, but can take a variety of forms to secure the weight 142 to the connector 141. It should be further noted that consistent with the invention the entire cradle member 140 need not be present, and that the weight receiving unit 152 can be simply mounted to the bottom of the kayak cockpit at a position, for example, directly in front of the seat 26 in order to secure the weight 142 without the use of the entire cradle member 140.

Figure 10:
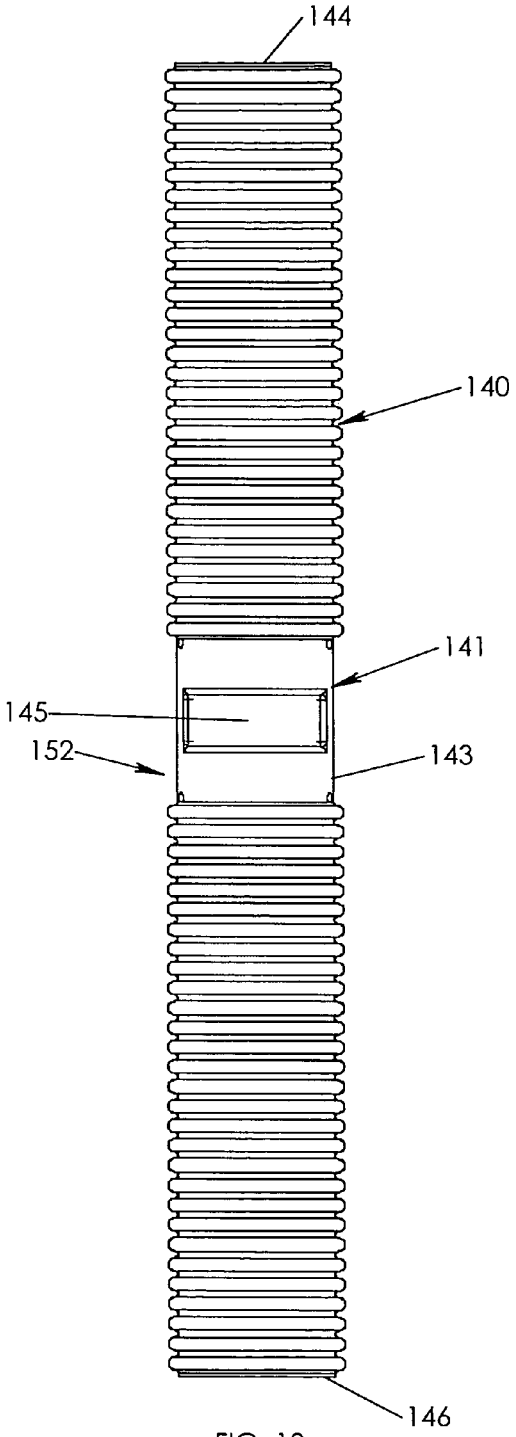
FIG. 10 is a top perspective view of the alternative embodiment of the cradle member illustrated in FIG. 8.
Figure 11:
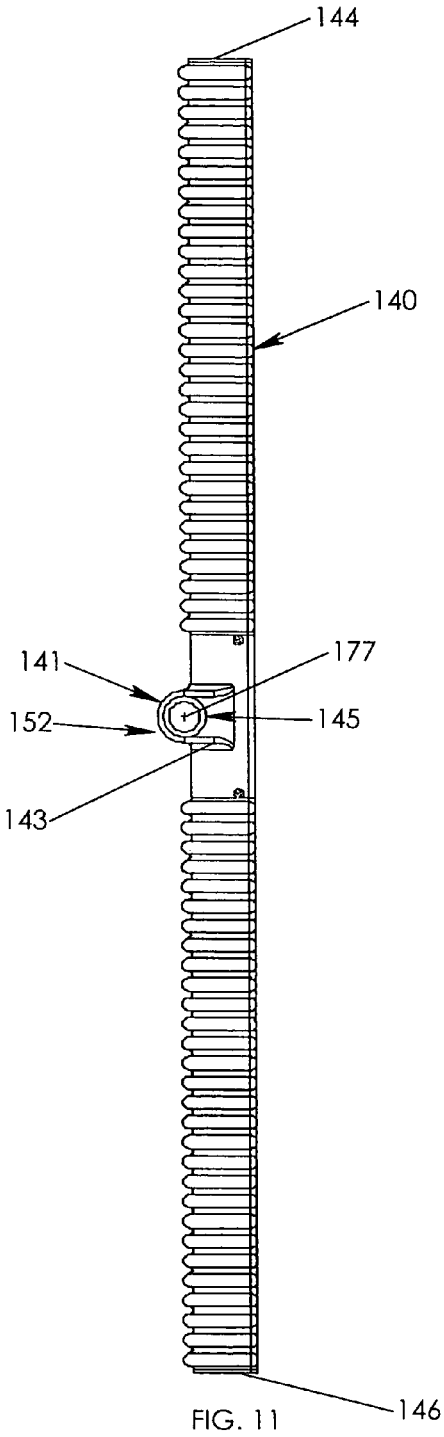
FIG. 11 is a side perspective of the alternative embodiment of the cradle member illustrated in FIG. 8.
Figure 14:
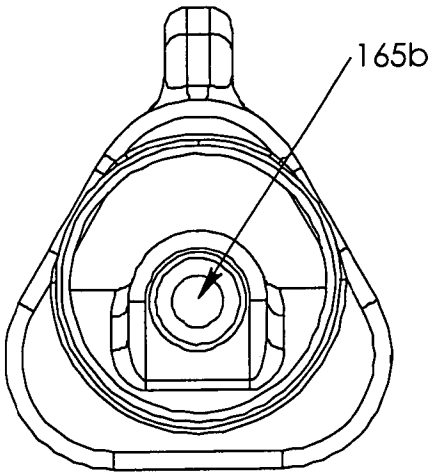
FIG. 14 is a rear perspective view of the alternative embodiment of the weight container.
Figure 13:
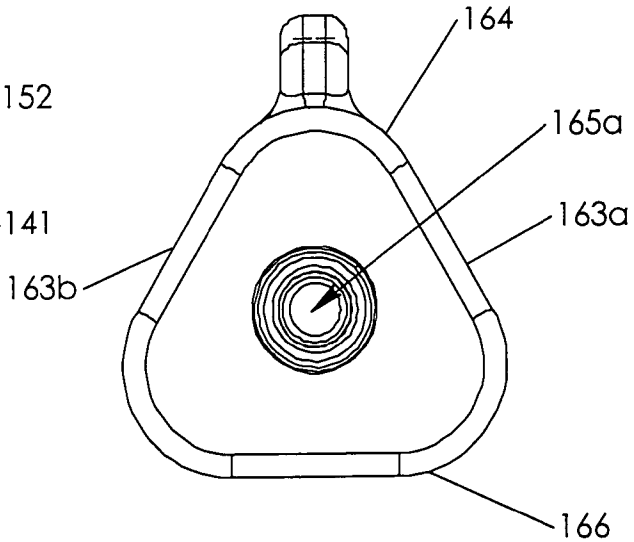
FIG. 13 is a front perspective view of an alternative embodiment of the weight container.
Figure 12:
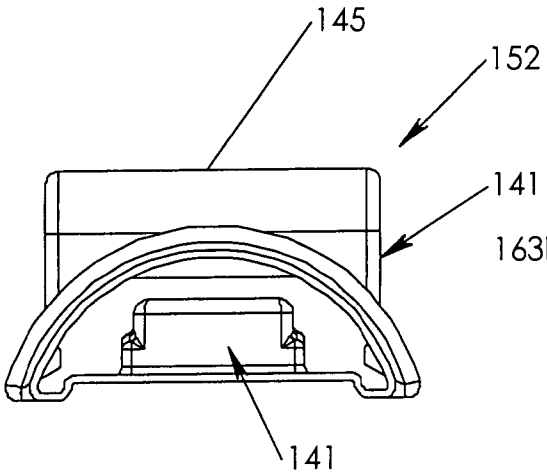
FIG. 12 is a sectional perspective view of the cradle member along lines 5—5 in FIG. 10.
Figure 15:
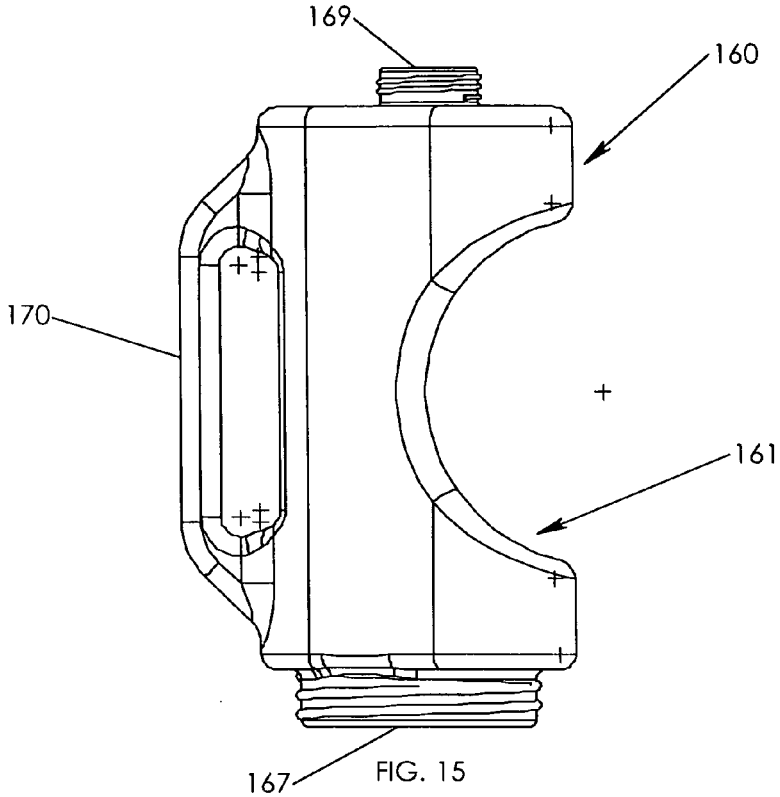
FIG. 15 is a side perspective view of the alternative embodiment of the weight container.
Figure 16:
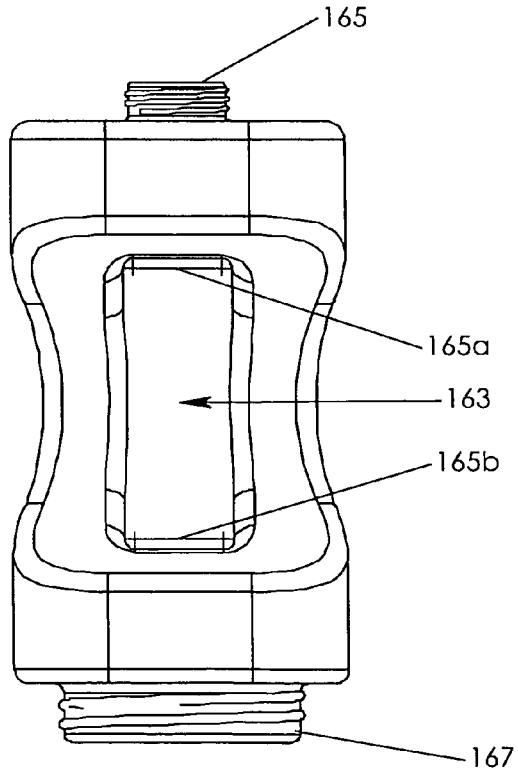
FIG. 16 is a bottom perspective view of the alternative embodiment of the weight container.
Figure 17A:
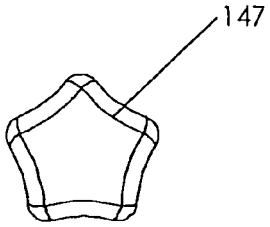
Figure 17B:
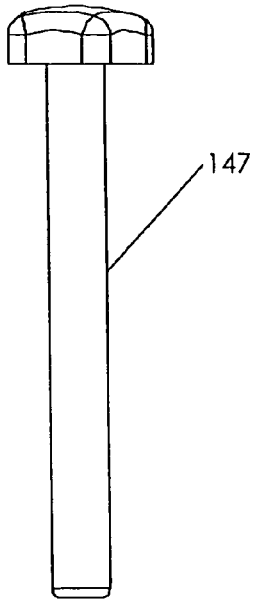
FIG. 17*b* is a side perspective view of the pin utilized with the ballast system illustrated in FIG. 8.
Figure 18:
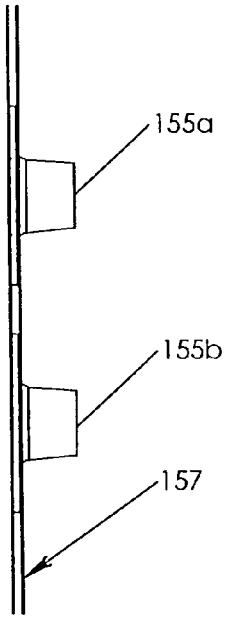
FIG. 18 is a side perspective view of the mounting plate utilized with the ballast system illustrated in FIG. 8.
Figure 19:
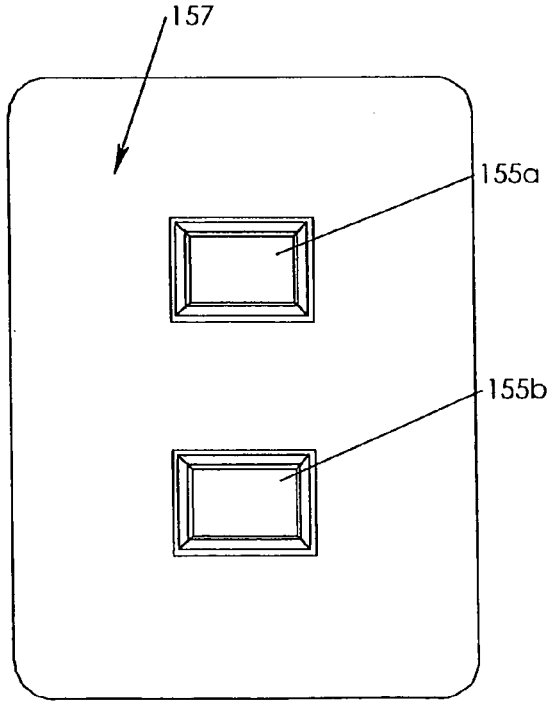
FIG. 19 is a perspective view of the mounting plate utilized with the ballast system illustrated in FIG. 8.

FIGS. 9 and 12 are cross-sectional views illustrating of the weight receiving unit 152 and connector 141. As illustrated in FIG. 10, the underside of weight receiving unit 152 includes two rectangular orifices 153. Orifices 153 are configured to tightly fit around the rectangular posts 155*a*, 155*b* of mounting plate 157 (FIGS. 18 and 19) and provide for an additional securing measure. The mounting plate 157 is illustrated in FIGS. 18 and 19, and may be mounted, for example, on the bottom 31 of the kayak at any preferred position of the ballast system 20. For example, mounting plate 157 may be mounted on the bottom of the kayak in front of the seat 26 of the kayak. The tight fit of the orifices 153 over the rectangular posts 155 of mounting plate 157 serves to stabilize the ballast system against undesired lateral or forward movement of the system within the kayak. It should be recognized that the mounting plate is not necessary to the practice of the invention but provides an additional securing measure.

FIGS. 13–16 illustrate an alternative embodiment of a container 160 for use with the second preferred embodiment. Container 160 includes a generally triangular body comprised of an upper surface 164 and a lower surface 166 and side surfaces 163*a*, 163*b*. Container includes a first threaded opening 169 configured to receive and retain locking pin 147 and a second threaded opening 167 configured to receive an end cap 162. Openings 169, 167 allow for insertion and removal of premanufactured weight such as lead shot or a wide variety of naturally occurring materials such as sand, rock, or water. An integral handle 170 is integrally formed along the upper surface 164 for ease of transport and manipulation of the container 160 within the system.

Container 160 is configured to fit over and lockingly engage the connector 141 of weight-receiving unit 152. Container 160 includes a connector engaging hollow 161 configured to fit over weight receiving unit 152 of cradle member 140. Within the hollow 161 is a connector receiving recess 163. Connector receiving recess 163 is of roughly the same dimensions as connector 141 such that container 160 fits tightly over connector 141. The container 160 includes through bores 165*a*, 165*b* extending from opposed sides of the connector receiving recess 163. Through bores 165*a*, 165*b* are configured to align with and are the same dimension as the passage of the tubular receiver 145 such that pin 147 may be inserted through tubular receiver 145 and through bores 165*a*, 165*b* to secure the container 160 to the weight receiving unit 152.

Figure 20:
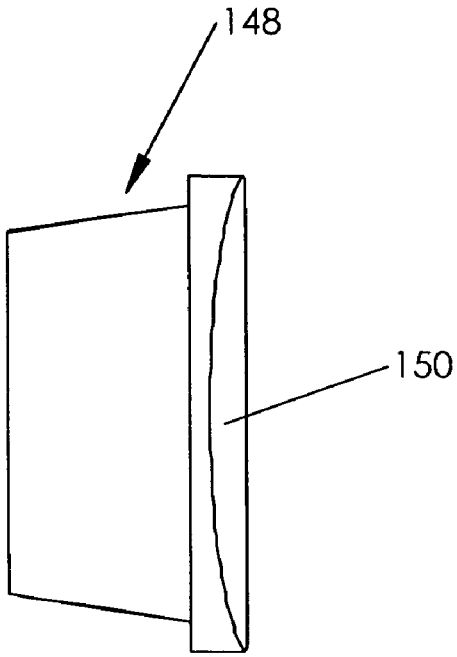
FIG. 20 is a top perspective view of an end cap utilized with the ballast system illustrated in FIG. 8.
Figure 21:
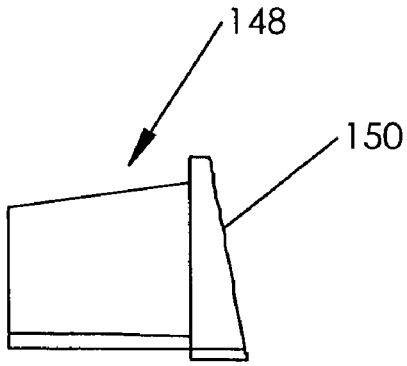
FIG. 21 is a side perspective view of an end cap utilized with the ballast system illustrated in FIG. 8.

FIGS. 20 and 21 illustrate rubber or plastic end caps 148 configured to be inserted into the first 144 and second 146 ends of the cradle member 140. End caps 148 are similar to those discussed in the previous embodiment, however, they are configured to assume the shape of the modified cradle member 140. Preferably, end caps 148 are removably press-fitted within the ends 144, 146 of the cradle member 140 to accommodate adjustment of the length of the cradle member. End caps 148 are configured to assist in press fitting cradle member 140 against the inner surface of the upper wall 49 of the kayak and hold the ballast system 122 in place. In the illustrated embodiment, end caps 148 include an angled face 150 to better fit against the arcuate contour of upper wall 49 of the kayak. As noted above, end caps 148 may additionally include a wide variety of friction enhancing mechanisms on the angled face 150 to maintain the ballast system in a desired location within the kayak.

Figure 22:
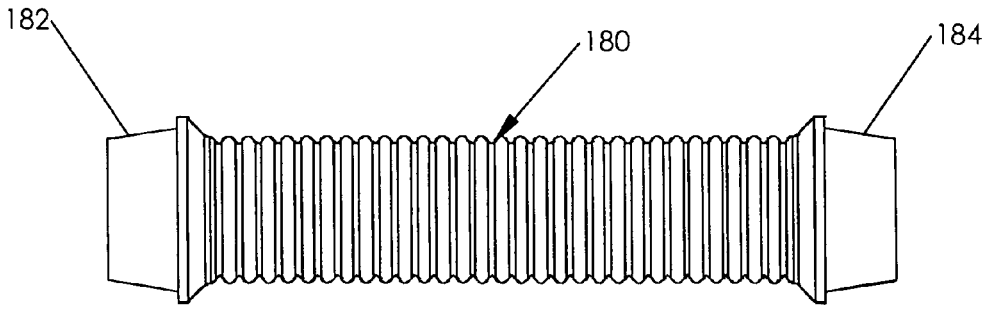
FIG. 22 is a top perspective view of the cradle extension member utilized with the ballast system illustrated in FIG. 8.
Figure 23:
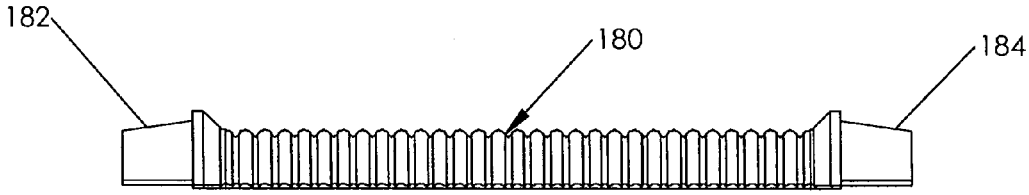
FIG. 23 is a side perspective view of the cradle extension member utilized with the ballast system illustrated in FIG. 8.
Figure 24:
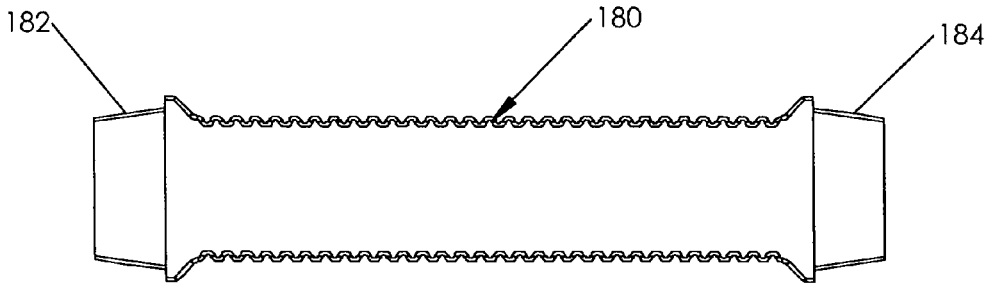
FIG. 24 is a bottom perspective view of the cradle extension member utilized with the ballast system illustrated in FIG. 8.

FIGS. 22–24 illustrate views of a cradle extension member 180 for use with the second preferred embodiment. Cradle extension member 180 is similarly a flexible tubular member having a first 182 and second 184 end. First 182 and second 184 ends are preferably constructed to fit within first 144 and second 146 ends of cradle member 140. Cradle extension member 180 is useful in situations where the U-shape of the cradle member does not provide a good press-fit within the interior of the kayak. In order to improve stability of the cradle member 140, cradle extension member 180 can be used to form or a circular cradle that engages both the top 49 and bottom 31 of the kayak.

Although the best mode contemplated by the inventor of carrying out the present invention is disclosed above, practice of the present invention is not limited thereto. It will be manifest that various additions, modifications and rearrangements of the features of the present invention may be made without deviating from the spirit and scope of the underlying inventive concept.

For example, the invention discloses in one embodiment a cradle member 40 and weight 42 in the form of a container 60. However, as noted above, weight 42 may take a variety of configurations in addition to container 60 including but not limited to lead diver's weights, sand bags or water containers. The container may include a variety of shapes so long as it may be secured to the ballast system. Additionally container 60 may be filled with virtually any material to add weight to the kayak. Alternatively, the cradle member 40 may include an integrally formed weight. Such weight could take a variety of configurations. The invention further discloses the optional use of straps to secure the ballast system 22 in place. In is understood that a wide variety of straps could be utilized to secure the weight within the cradle, and the ballast system within the kayak. Alternatively, a retention member such as a plastic stop could be secured to the floor of the kayak to hold the ballast system in place.

Additionally, the preferred embodiments describe cradle members 40, 140 that include weight receiving units 152. It should be understood that the entire cradle member is not necessary to the practice of the invention and the weight receiving unit of the cradle member could be mounted to the kayak at the preferred positioning location, thereby eliminating the need for the entire cradle member. For example, the weight receiving unit 152, including the connector 141 could be mounted in front of a kayak seat or formed integrally with the seat thereby eliminating the need for such additional features as the mounting plate 157 and remainder of the cradle 140.

It is intended that the appended claims cover all such additions, modifications and rearrangements. Expedient embodiments of the present invention are differentiated by the appended claims.

It is claimed:

1. A ballast system for a watercraft comprising an elongate flexible cradle member defining a first end and a second end and configured to be secured against the interior of said watercraft, and wherein said cradle member defines a receiving unit along a portion of the cradle member for attaching weight; and wherein said cradle member includes a receiver and said weight defines a recess configured to receive said receiver; and wherein said weight defines at least one through bore configured to align with a passage on said receiver, said through bore and said passage configured to receive a pin therethrough.

2. The ballast system of claim 1, wherein said weight is comprised of a container said container comprising at least one opening allowing access to the interior of said container.

3. The ballast system of claim 1, further comprising a mounting plate configured to be attached to the bottom of the watercraft, wherein said mounting plate is configured to engage to the underside of said cradle member and limit movement of said cradle member.

4. The ballast system of claim 1, wherein the watercraft is a kayak and said system is secured to the interior of the kayak by straps.

5. The ballast system of claim 4, wherein said straps are secured to a bulkhead of the kayak.

6. The ballast system of claim 1, further comprising at least one end cap attached to an end of said cradle, said end cap engaging an interior wall of said watercraft.

7. The ballast system of claim 1, wherein said watercraft is a sea kayak.

8. A kayak ballast device comprising a weight receiving unit configured to be attached to the interior of a kayak and attach to a container, said container configured to be received by said weight receiving unit and defining an opening, a weight for placement and removal in the opening; and wherein the container is releaseably secured to the weight receiving unit by a removable pin inserted into the weight receiving unit and the weight.

9. The kayak ballast system of claim 8, wherein said container defines at least one through bore configured to align with a passage on said weight receiving unit, said through bore and said passage configured to receive a pin therethrough.

10. The kayak ballast device of claim 8, wherein said ballast device includes a cradle member supporting said weight receiving unit, said cradle member configured to be press-fitted within the interior of said kayak.

11. The kayak ballast device of claim 10, wherein said cradle member includes an end cap that includes an angled face.

12. The kayak ballast device of claim 8, further comprising a mounting plate configured to be attached to the bottom of the kayak, wherein said mounting plate is configured to engage to the underside of said weight receiving unit.

13. The kayak ballast system of claim 12, wherein said mounting plate comprises at least one projection configured to engage a recess on said weight receiving unit.

14. A method of adjusting the center of gravity in a kayak said method comprising the steps of:

providing a support configured to be positioned within the interior of a kayak, said support defining a weight receiving unit;

positioning said support within the interior of the kayak; and releaseably securing a weight to said weight receiving unit with a removable pin inserted into the weight receiving unit and the weight.

15. The method of claim 14, wherein the weight is a container defining at least one opening and the method further comprises the step of filling the container with a material.

16. The method of claim 14, wherein said weight defines at least one through bore configured to align with a passage on said weight receiving unit, said through bore and said passage configured to receive the pin therethrough.

* * * * *